US009233559B2

(12) United States Patent
Young et al.

(10) Patent No.: US 9,233,559 B2
(45) **Date of Patent: *Jan. 12, 2016**

(54) SYSTEM FOR APPLYING VACUUM FORCE ON WEB

(71) Applicant: Eastman Kodak Company, Rochester, NY (US)

(72) Inventors: Timothy John Young, Williamson, NY (US); Gregory R. Kulzer, Rochester, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/291,156

(22) Filed: May 30, 2014

(65) Prior Publication Data

US 2015/0343801 A1 Dec. 3, 2015

(51) Int. Cl.
*B41J 2/01* (2006.01)
*B41J 11/00* (2006.01)

(52) U.S. Cl.
CPC ..... *B41J 11/0085* (2013.01)

(58) Field of Classification Search
CPC ..... B41J 2/0057; B41J 2/01; B41J 2/04563; B41J 2/0458; B41J 2/2114; B41J 11/0015; B41J 11/007; B41J 11/06; B41J 11/42; B41J 29/393
USPC ..... 347/14, 16, 101, 103, 104
See application file for complete search history.

(56) References Cited

U.S. PATENT DOCUMENTS

2010/0213666 A1* 8/2010 Harney et al. ..... 271/276
2011/0292145 A1* 12/2011 Hoover et al. ..... 347/104

* cited by examiner

*Primary Examiner* — Manish S Shah
*Assistant Examiner* — Roger W Pisha, II
(74) *Attorney, Agent, or Firm* — Amit Singhal; William R. Zimmerli

(57) ABSTRACT

Apparatus for causing a vacuum force to be applied across a width of a print medium as it moves through a printing system and for determining whether the edge seals are positioned correctly is disclosed. A vacuum chamber is connected to a vacuum source which provides vacuum to the vacuum chamber. Spaced sealing rollers and the edge seals define an opening in the vacuum chamber, wherein the print medium passes over the opening and is guided by the sealing rollers. A sensor measures a vacuum level in the vacuum chamber. A controller stores a plurality of response curves for different known print media, produces first and second signals indicative of an activation level of the vacuum source and the vacuum level in the vacuum chamber, and compares the first and second signal to appropriate response curves to produce an error signal indicating whether the edge seals are correctly positioned.

20 Claims, 13 Drawing Sheets

SYSTEM FOR APPLYING VACUUM FORCE ON WEB

CROSS REFERENCE TO RELATED APPLICATIONS

Reference is made to commonly-assigned, U.S. patent application Ser. No. 14/291,145, entitled "METHOD FOR APPLYING VACUUM FORCE ON WEB", Ser. No. 14/291,173, entitled "METHOD FOR APPLYING VACUUM FORCE ON WEB", Ser. No. 14/291,184, entitled "SYSTEM FOR APPLYING VACUUM FORCE ON WEB", Ser. No. 14/291,195, entitled "METHOD FOR GENERATING VACUUM RESPONSE CURVES", Ser. No. 14/291,207, entitled "SYSTEM FOR GENERATING VACUUM RESPONSE CURVES", all filed concurrently herewith.

FIELD OF THE INVENTION

The present invention generally relates to printing systems and more particularly to the use of vacuum to pull down a web of print media between rollers in the printing system.

BACKGROUND OF THE INVENTION

In a digitally controlled printing system, such as an inkjet printing system, a print media is directed through a series of components. The print media can be a cut sheet or a continuous web. A web or cut sheet transport system physically moves the print media through the printing system. As the print media moves through the printing system, liquid, for example, ink, is applied to the first side of the print media by one or more printheads through a process commonly referred to as jetting of the liquid. The jetting of liquid onto the print media introduces significant moisture content to the print media, particularly when the system is used to print multiple colors on the print media. Due to its moisture content, the print media expands and contracts in a non-isotropic manner often with significant hysteresis. The continual change of dimensional characteristics of the print media often adversely affects image quality. Although drying is used to remove moisture from the print media, drying too frequently, for example, after printing each color, also causes changes in the dimensional characteristics of the print media that often adversely affects image quality.

FIG. 1 illustrates a portion of the print media 112 as the print media passes over two rollers 68 and 70 that support the print media under each row of printheads in accordance with the prior art. The print media 112 is moving in a direction of media travel 60, also referred to as the intrack direction. Perpendicular to the intrack direction 60, and to the local normal to the surface of the print media, is the crosstrack direction 62. During the inkjet printing process, the print media can expand as the print media absorbs the water-based inks applied to it. When the direction of expansion is in the direction that is perpendicular to the direction of media travel 60, it is often referred to as expansion in the crosstrack direction 62. Typically, the wrap of the print media around a roller of the inkjet printing system produces sufficient friction between the print media and the roller that the print media is not free to slide in the crosstrack direction even though the print media is expanding in that direction. This can result in localized buckling of the print media away from the roller to create lengthwise ripples, also called flutes or wrinkles, in the print media. Flutes or ridges 64, 66 can be produced in the print media due to expansion of the print media in the crosstrack direction 62 because the print media cannot slip on the rollers 68, 70. Wrinkling of the print media during the printing process often leads to permanent creases forming in the print media that ultimately affect image quality.

Multiple printheads are typically located and aligned by a support structure to form a linehead, with the linehead located over the print media. In many such systems, the support structure of the linehead locates the printheads in two or more rows; the rows positioned parallel to each other and aligned in the crosstrack direction. To prevent the print media from fluttering, or vibrating up and down in the print zone, the print media is supported by a roller that is aligned with the print line of each row of printheads. It is not uncommon for the bottom face of the support structure to become wet, either due to condensation from the moist air produced by the printing process or due to mist drops created by the print drops striking the print media.

It has been found that under some printing conditions the flutes in the print media can be sufficiently tall that top of the flutes can contact the bottom face of the support structure. When this occurs, the moist ink on the flutes can be smeared by the contact. Additionally, the moisture on the bottom of the support structure can be transferred to the print media. The result is a degradation of the print quality.

Vacuum can be applied to the print media 112 to deflect the print media away from the linehead, thus reducing the formation of flutes or wrinkles in the print media. When the print media is deflected away from the linehead, there is less likelihood of smearing of the moist ink on the print media due to accidental contact with the linehead. One of the issues with applying vacuum to the print media is ensuring that the vacuum is applied uniformly across the print media in the cross track direction. If the vacuum manifold opening is larger than the width of the print media, there is leakage of air that can result in the print media not being deflected away from the linehead. If the width of the vacuum manifold is less than the width of the print media, the portion of the print media not under the influence of the vacuum force is not deflected away from the linehead, increasing the likelihood of smearing of moist ink on the these portions of print media due to accidental contact with the linehead. Furthermore, the portions of the web not under the influence of the vacuum can flutter, resulting in print quality degradation. There remains a need to better manage the vacuum, provided by the vacuum assembly, near the edges of the print media.

SUMMARY OF THE INVENTION

In one aspect of the present invention, an apparatus for causing a vacuum force to be applied at a target vacuum level across a width of a web of movable print medium as it moves through a printing system and for determining whether positions of adjustable edge seals of the apparatus do not correspond to edge positions of the movable print medium comprises, a vacuum chamber connected to a vacuum source, wherein the vacuum source provides vacuum to the vacuum chamber, spaced sealing rollers, disposed in relation to the vacuum chamber, wherein the spaced sealing rollers define an opening in the vacuum chamber, and wherein the movable print medium passes over the opening and is guided by the sealing rollers, the adjustable edge seals disposed between the spaced sealing rollers at a first position, a sensor for measuring a vacuum level in the vacuum chamber, and a controller having controller accessible memory for storing a plurality of response curves for different known print media having different widths, materials, or thickness, responsive to the vacuum source and the sensor, for producing a first signal indicative of an activation level of the vacuum source and a second signal indicative of the vacuum level in the vacuum chamber, and for comparing the first and second signal to appropriate response curves corresponding to the movable print medium to produce an error signal indicating whether the first position of the pair of edge seals does not correspond to the width of the movable print medium.

The present invention has significant advantages over prior art. It provides a simple means for determining that the edge seals are correctly positioned. This permits the vacuum to be uniformly applied across the entire width of the print medium, overcoming the problems of leakage of air due to the vacuum manifold being larger than the width of the print medium, or the fluttering of the edges of the print medium due to the vacuum manifold being smaller than the width of the print medium. The present invention does not required additional hardware such as encoders or sensors to ensure correct spacing of the edge seals.

DETAILED DESCRIPTION OF THE INVENTION

Figure 1:
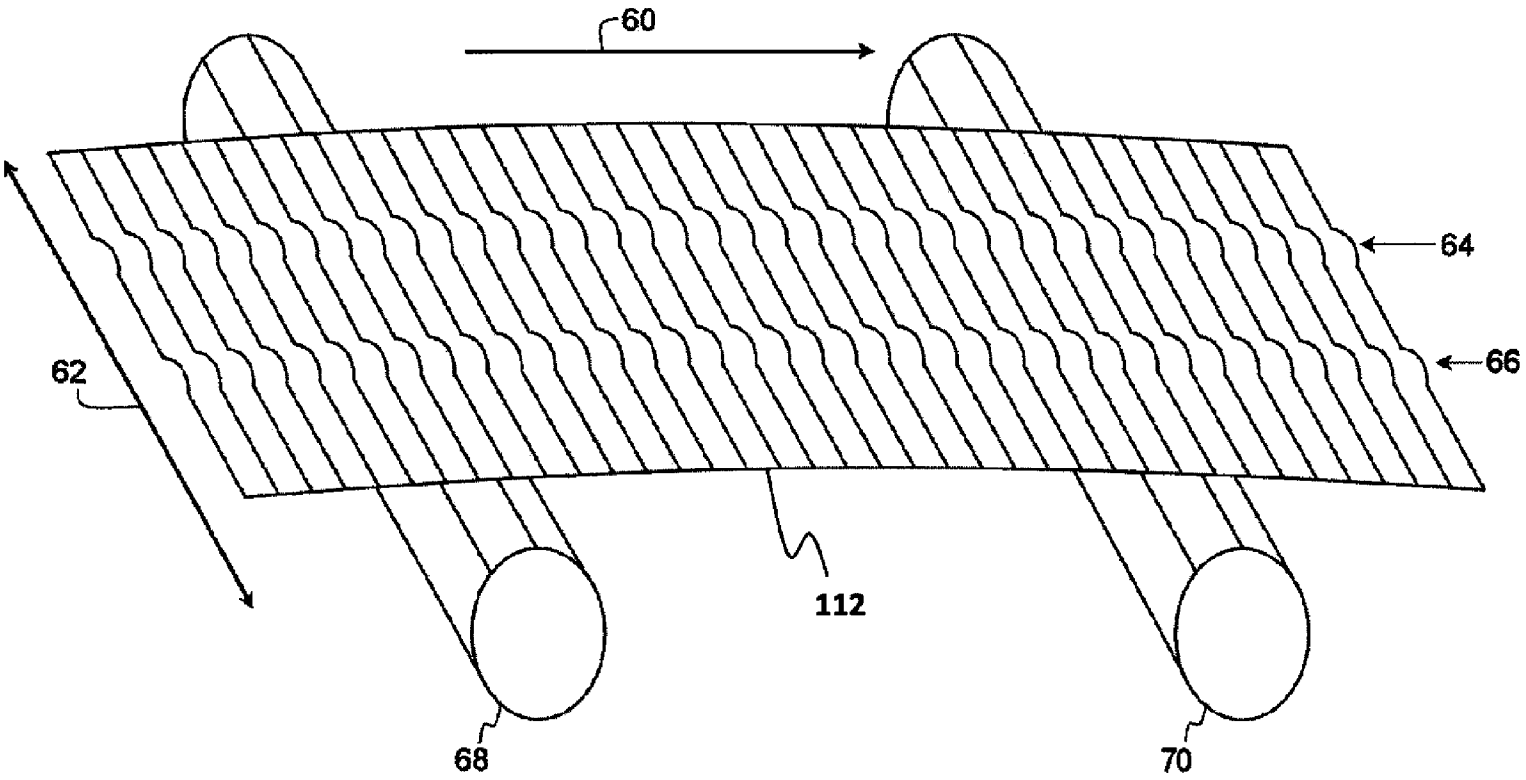
FIG. 1 illustrates a portion of the print media as the print media passes over two rollers that support the print media under each row of printheads in accordance with the prior art.

Throughout the specification, the following terms take the meanings explicitly associated herein, unless the context clearly dictates otherwise. The meaning of "a," "an," and "the" includes plural reference, the meaning of "in" includes "in" and "on." Additionally, directional terms such as "on", "over", "top", "bottom", "left", "right" are used with reference to the orientation of the Figure(s) described. Because components of aspects of the present invention can be positioned in a number of different orientations, the directional terminology is used for purposes of illustration only and is in no way limiting.

The present description will be directed in particular to elements forming part of, or cooperating more directly with, an apparatus in accordance with the present invention. It is to be understood that elements not specifically shown, labeled, or described can take various forms well known to those skilled in the art. In the following description and drawings, identical reference numerals have been used, where possible, to designate identical elements. It is to be understood that elements and components can be referred to in singular or plural form, as appropriate, without limiting the scope of the invention.

The example aspects of the present invention are illustrated schematically and not to scale for the sake of clarity. One of ordinary skill in the art will be able to readily determine the specific size and interconnections of the elements of the example aspects of the present invention.

As described herein, the example aspects of the present invention can be used in printing systems, including inkjet printing systems that include a printhead or printhead components. Many applications are emerging which use inkjet printheads to emit liquids (other than inks) that need to be finely metered and deposited with high spatial precision. Such liquids include inks, both water based and solvent based, that include one or more dyes or pigments. These liquids also include various substrate coatings and treatments, various medicinal materials, and functional materials useful for forming, for example, various circuitry components or structural components. As such, as described herein, the terms "liquid" and "ink" refer to any material that is ejected by the printhead or printhead components described below.

Inkjet printing is commonly used for printing on paper. However, there are numerous other materials in which inkjet is appropriate. For example, vinyl sheets, plastic sheets, textiles, paperboard, and corrugated cardboard can comprise the print media. Additionally, although the term inkjet is often used to describe the printing process, the term jetting is also appropriate wherever ink or other liquids is applied in a consistent, metered fashion, particularly if the desired result is a thin layer or coating.

Inkjet printing is a non-contact application of an ink to a print media. Typically, one of two types of ink jetting mechanisms are used and are categorized by technology as either drop on demand ink jet (DOD) or continuous ink jet (CIJ). The first technology, "drop-on-demand" (DOD) ink jet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CIJ) printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous printing technology uses thermal stimulation of the liquid jet with a heater to form drops that eventually become print drops and non-print drops. Printing occurs by selectively deflecting one of the print drops and the non-print drops and catching the non-print drops. Various approaches for selectively deflecting drops have been developed including electrostatic deflection, air deflection, and thermal deflection.

Additionally, there are typically two types of print media used with inkjet printing systems. The first type is commonly referred to as a continuous web while the second type is commonly referred to as a cut sheet(s). The continuous web of print media refers to a continuous strip of media, generally originating from a source roll. The continuous web of print media is moved relative to the inkjet printing system components via a web transport system, which typically include drive rollers, web guide rollers, and web tension sensors. Cut sheets refer to individual sheets of print media that are moved relative to the inkjet printing system components via rollers and drive wheels or via a conveyor belt system that is routed through the inkjet printing system. The print media has a print side adapted to receive liquid or ink from a linehead, and a non-print side.

The invention described herein is applicable to both types of printing technologies. As such, the terms printhead and linehead, as used herein, are intended to be generic and not specific to either technology. Additionally, the invention described herein is applicable to both types of print media. As such, the terms web and print media, as used herein, are intended to be generic and not as specific to either type of print media or the way in which the print media is moved through the printing system.

Figure 2:
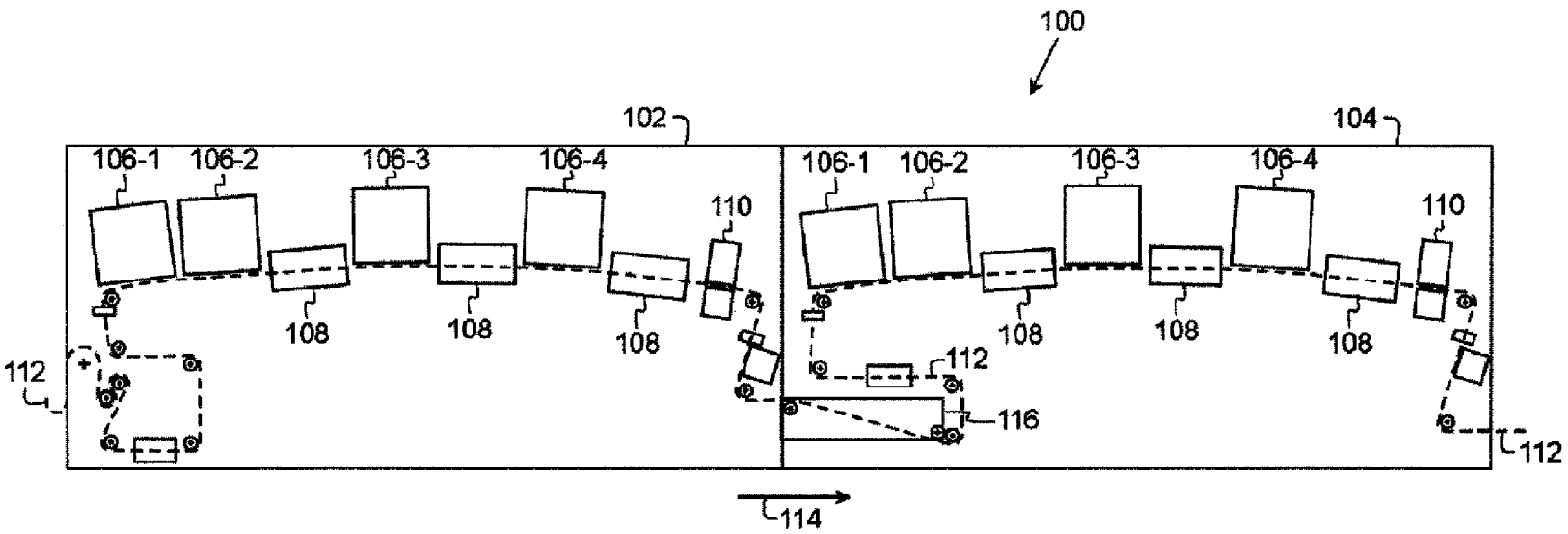
FIG. 2 is a schematic side view of one example of an inkjet printing system that prints on a continuous web of print media.
Figure 3:
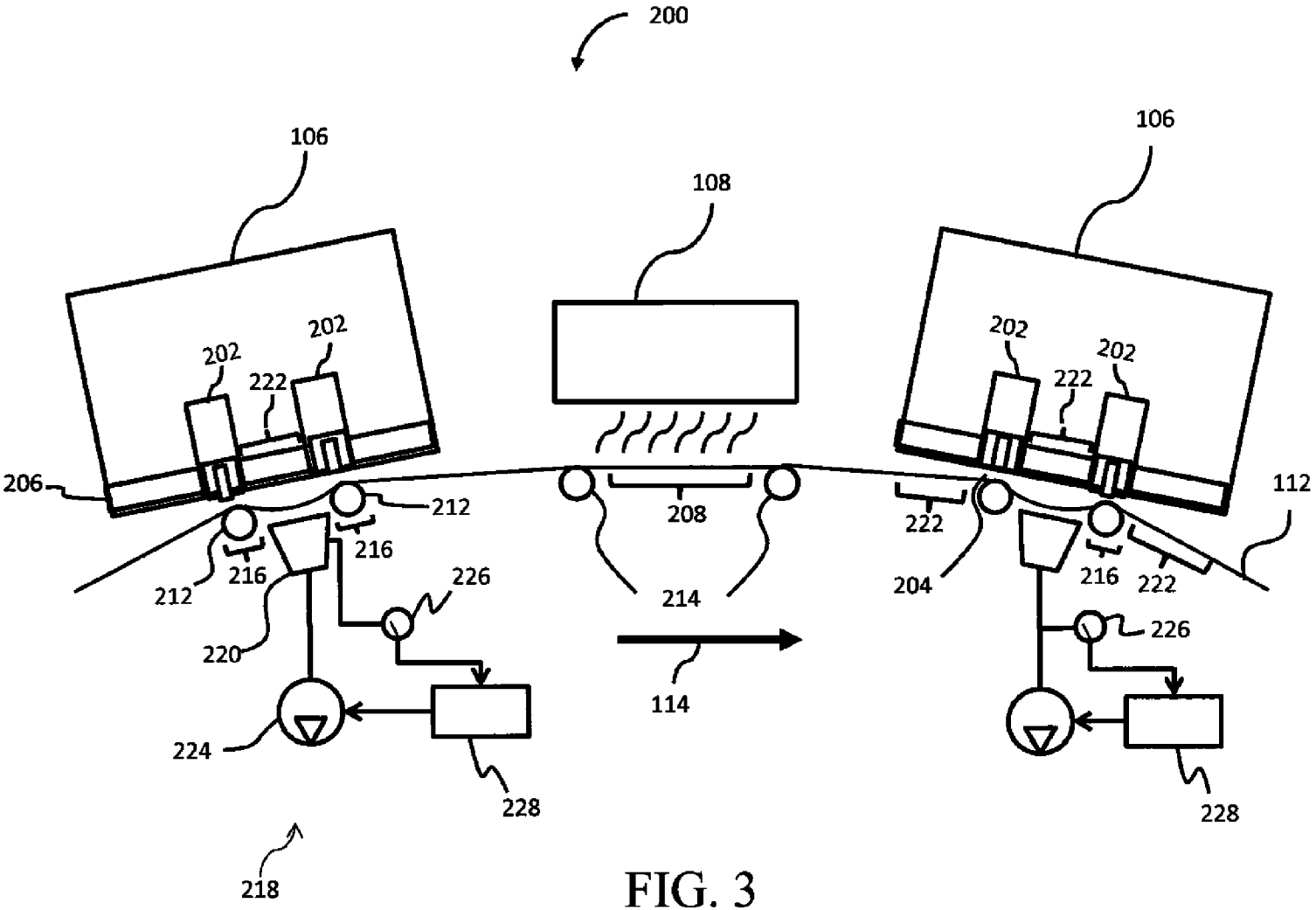
FIG. 3 is a schematic side view of an example of a first printing system according to an aspect of the invention.

The terms "upstream" and "downstream" are terms of art referring to relative positions along the transport path of the print media; points on the transport path move from upstream to downstream. In FIGS. 2 and 3, the media moves in the direction indicated by transport direction arrow 114. Where they are used, terms such as "first", "second", and so on, do not necessarily denote any ordinal or priority relation, but are simply used to more clearly distinguish one element from another.

Referring now to the schematic side view of FIG. 2, there is shown one example of an inkjet printing system that prints on a continuous web of print media. Printing system 100 includes a first printing module 102 and a second printing module 104, each of which includes lineheads 106, dryers 108, and a quality control sensor 110. Each linehead 106 typically includes multiple printheads (not shown) that apply ink or another liquid to the surface of the print media 112 that is adjacent to the printheads. For descriptive purposes only, the lineheads 106 are labeled a first linehead 106-1, a second linehead 106-2, a third linehead 106-3, and a fourth linehead 106-4. In the illustrated aspect of the present invention, each linehead 106-1, 106-2, 106-3, 106-4 applies a different colored ink to the surface of the print media 112 that is adjacent to the lineheads. By way of example only, linehead 106-1 applies cyan colored ink, linehead 106-2 magenta colored ink, linehead 106-3 yellow colored ink, and linehead 106-4 black colored ink.

The first printing module 102 and the second printing module 104 also include a web tension system that serves to physically move the print media 112 through the printing system 100 in the transport direction shown by the transport direction arrow 114 (left to right as shown in the figure). The print media 112 enters the first printing module 102 from a source roll (not shown) and the linehead(s) 106 of the first module applies ink to one side of the print media 112. As the print media 112 feeds into the second printing module 104, a turnover module 116 is adapted to invert or turn over the print media 112 so that the linehead(s) 106 of the second printing module 104 can apply ink to the other side of the print media 112. The print media 112 then exits the second printing module 104 and is collected by a print media receiving unit (not shown).

Although FIG. 2 depicts each printing module with four lineheads 106, three dryers 108, and one quality control sensor 110, aspects in accordance with the invention are not limited to this construction. A printing system can include any number of lineheads, any number of dryers, and any number of quality control sensors. The printing system can also include a number of other components, including, but not limited to, web cleaners, web steering components, and web tension sensors.

And although the printing system shown in FIG. 2 has the turnover module 116 disposed within the second printing modules 104, other printing systems can include the turnover module within the first printing module 102, or located physically between the two modules.

FIG. 3 depicts an example of an inkjet printing system according to an aspect of the invention. A print media 112 passes through the printing system 200, supported and guided by rollers 212, 214 that are located opposite a first side of the print media. The lineheads 106 and the dryers 108 of the printing system 200 are positioned opposite a first side of the print media 112. As the print media 112 is directed through the printing system 200, the lineheads 106, which typically include printheads 202, apply ink or another liquid to the first side of the print media 112 via the nozzle arrays 204 of the printheads 202. The printheads 202 within each linehead 106 are typically located and aligned by a support structure 206.

After the ink is jetted onto the print media 112, the print media 112 passes beneath the dryer 108, which applies air or heat 208 to the print media to dry the ink. The print media 112 is guided as it passes through the printing system 200 by rollers 212, 214. As the print media 112 is guided past the lineheads 106 and dryers 108, the rollers are arranged along an arc so that the print media is held in tension against each of the rollers 212, 214. To prevent the print media that is opposite the lineheads 106 from fluttering and contacting the linehead 106, the print media 112 is supported by rollers 212 that are aligned with each row of printheads 202.

The rows of printheads 202 each form a print zone 216 for a linehead 106. A vacuum assembly 218 includes a vacuum manifold 220 which is located between the rollers 212 located at the print zones 216 in the illustrated embodiment of the present invention. The vacuum manifold 220 is positioned opposite a second side of the print media 112 and is not aligned with the print zones 216 of a linehead 106. Instead, the vacuum manifold 220 is aligned with a non-print zone 222. The vacuum manifold 220 is positioned laterally adjacent to one or more print zones of a linehead. For example, in the illustrated aspect, the vacuum manifold 220 is laterally adjacent to and positioned between the print zones 216 of the linehead 106.

The vacuum assembly 218 also includes a vacuum source 224 that is fluidically coupled to the vacuum manifold 220. In some aspects of the present invention, a single vacuum source can be used to provide a vacuum force to multiple vacuum manifolds located along the transport path of the print media. Additionally, in some aspects of the present invention, the vacuum source can be located remotely from the printing system, such as a house vacuum system, which is connected to the one or more vacuum manifolds of the printing system by means of vacuum ducts. The vacuum assembly 218 also includes a vacuum sensor 226 to provide a measure of the vacuum in the vacuum manifold. The vacuum sensor 228 can provide a direct or indirect measurement of the vacuum level in the vacuum manifold as will be described later.

Figure 4:
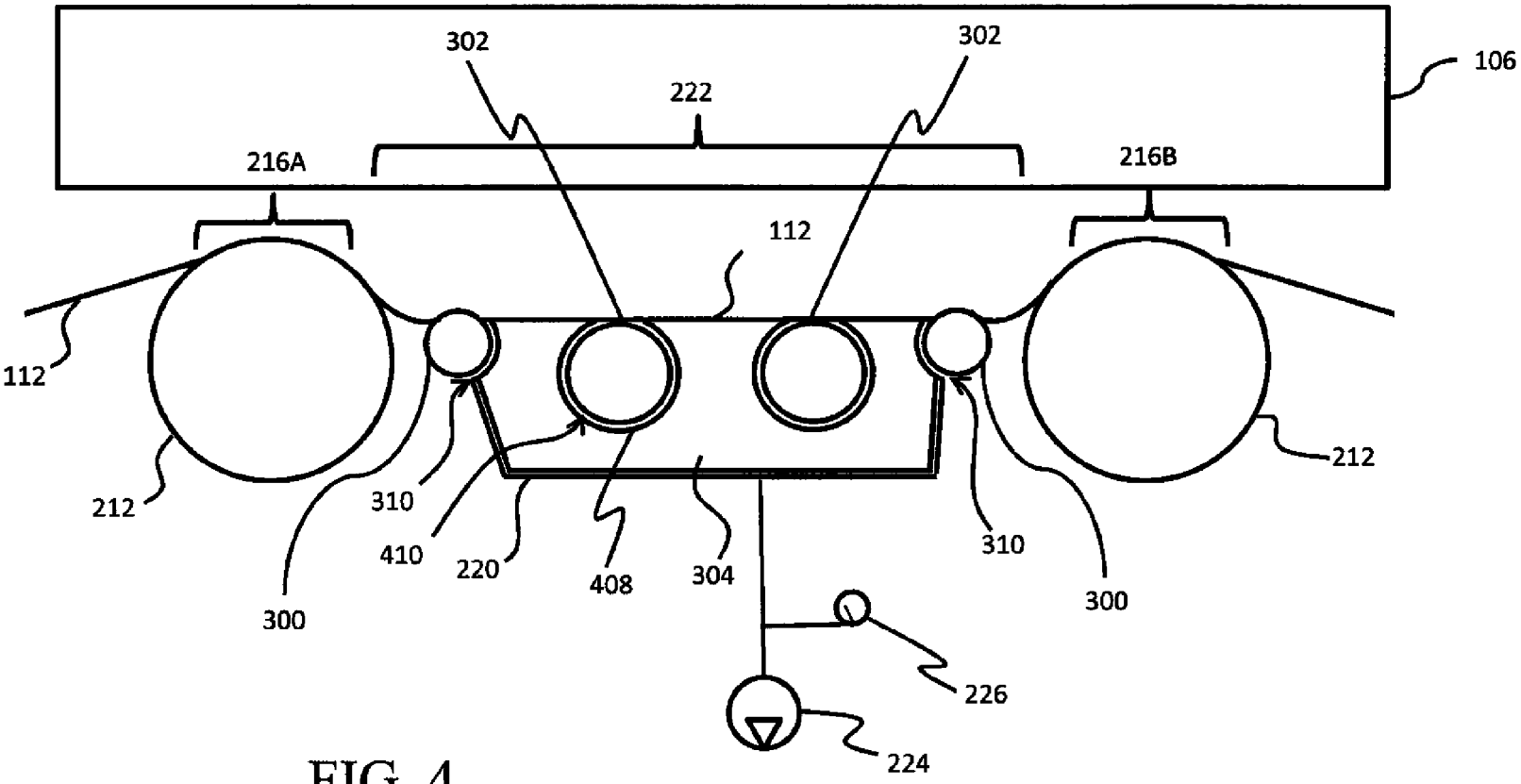
FIG. 4 is a more detailed side view of a portion of the first printing system shown in FIG. 3.

Referring now to FIG. 4, there is shown a more detailed side view of a portion of the printing system shown in FIG. 3. Sealing rollers 300 are positioned laterally adjacent to the vacuum manifold 220 and limit the flow of air into the vacuum manifold 220 along the leading and trailing edges of the vacuum manifold. The sealing rollers 300 are positioned in the non-print zone 222 and are recessed below the plane or level defined by the contact of the print media 112 with the top of rollers 212. The sealing rollers 300 support the print media 112 to create an air seal between the sealing rollers 300 and the print media 112. In one aspect of the present invention, the surface speed of the sealing rollers matches the speed of the print media because the sealing rollers 300 rotate as the print media moves over each sealing roller. To enable the sealing rollers 300 to rotate there must be a clearance gap 310 between the sealing rollers and the adjacent wall of the vacuum manifold. To limit the amount of air that can flow through this clearance gap into the vacuum manifold 220, the clearance gap is kept to a minimum, typically about 0.003 inch. To further limit the air flow through the clearance gap preferably has an extended length around the perimeter of the sealing roller so that air must flow through the thin clearance gap 310 for an extended length before entering the vacuum manifold. In a preferred embodiment, the clearance gap extends around about ¼ the way around the sealing roller 300.

Guide surfaces 302 support the print media 112 in the opening of the vacuum manifold 220. Examples of guide surfaces 302 include, but are not limited to, rollers, non-rotating rods, or curved sheet metal surfaces. The guide surfaces 302 are also recessed below the plane or level defined by the contact of the print media 112 with the top of rollers 212. The print media 112 passes over the guide surfaces 302 when the print media is pulled down by a vacuum in the vacuum manifold. The guide surfaces 302 assist in stabilizing the print media 112 as the print media is pulled away from the linehead 106 by the vacuum. By stabilizing the print media 112 in the non-print zone 222, the guide surfaces 302 enable a more consistent print media path length between the print zones 216 of the linehead 106. This produces more consistent registration of the ink or liquid deposited on the print media 112 in the upstream print zone 216A with the ink or liquid deposited on the print media in the downstream print zone 216B of the linehead.

Figure 7:
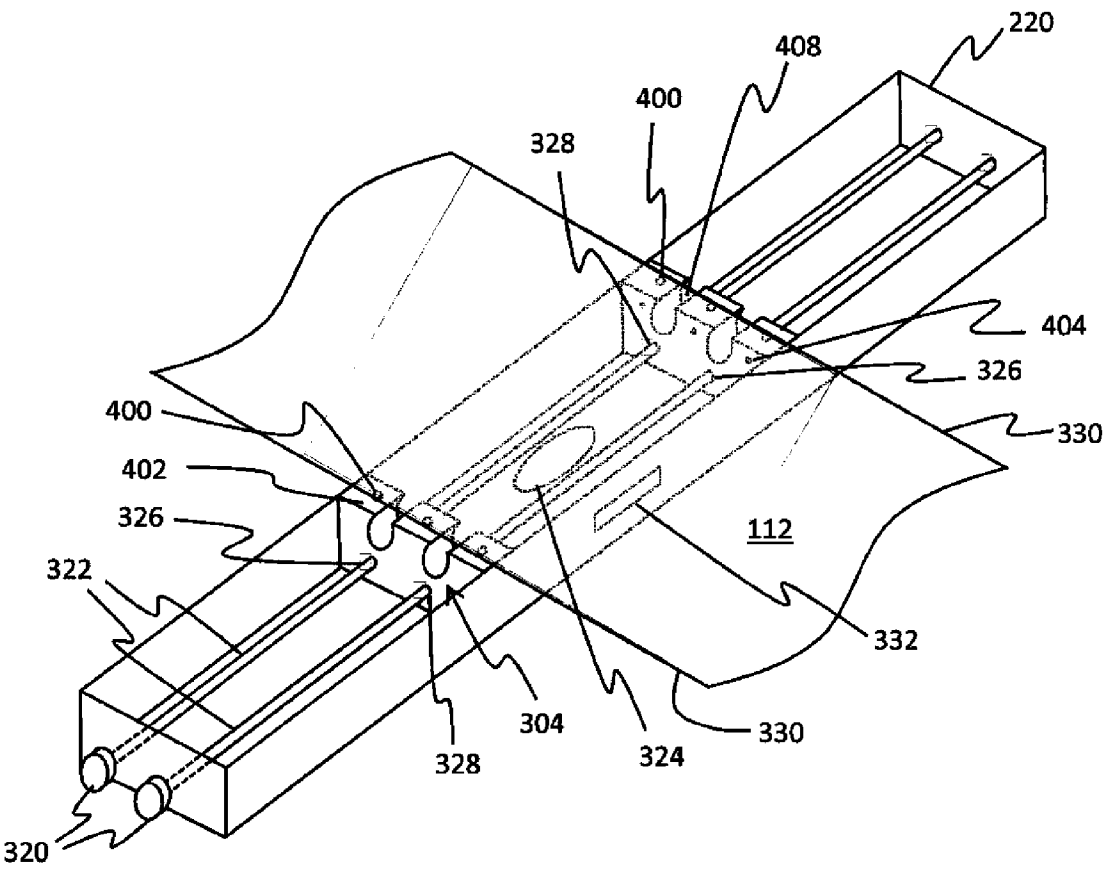
FIG. 7 is another perspective view of a portion of the printing system showing the layout of the edge seals according to an aspect of the invention.

Edge seals 304 are disposed in the opening of the vacuum manifold 220, and are ideally aligned with the edges of the print media as shown in FIG. 7. The edge seals 304 support the edges of the print media and limit the amount of air drawn into the vacuum manifold 220 from around the edges of the print media. The edge seals 304 are recessed below the plane or level defined by the contact of the print media 112 with the top of rollers 212. The edge seals 304 are positioned opposite a second side of the print media 112 and located within the non-print zone 222 of the linehead 106.

Figure 5:
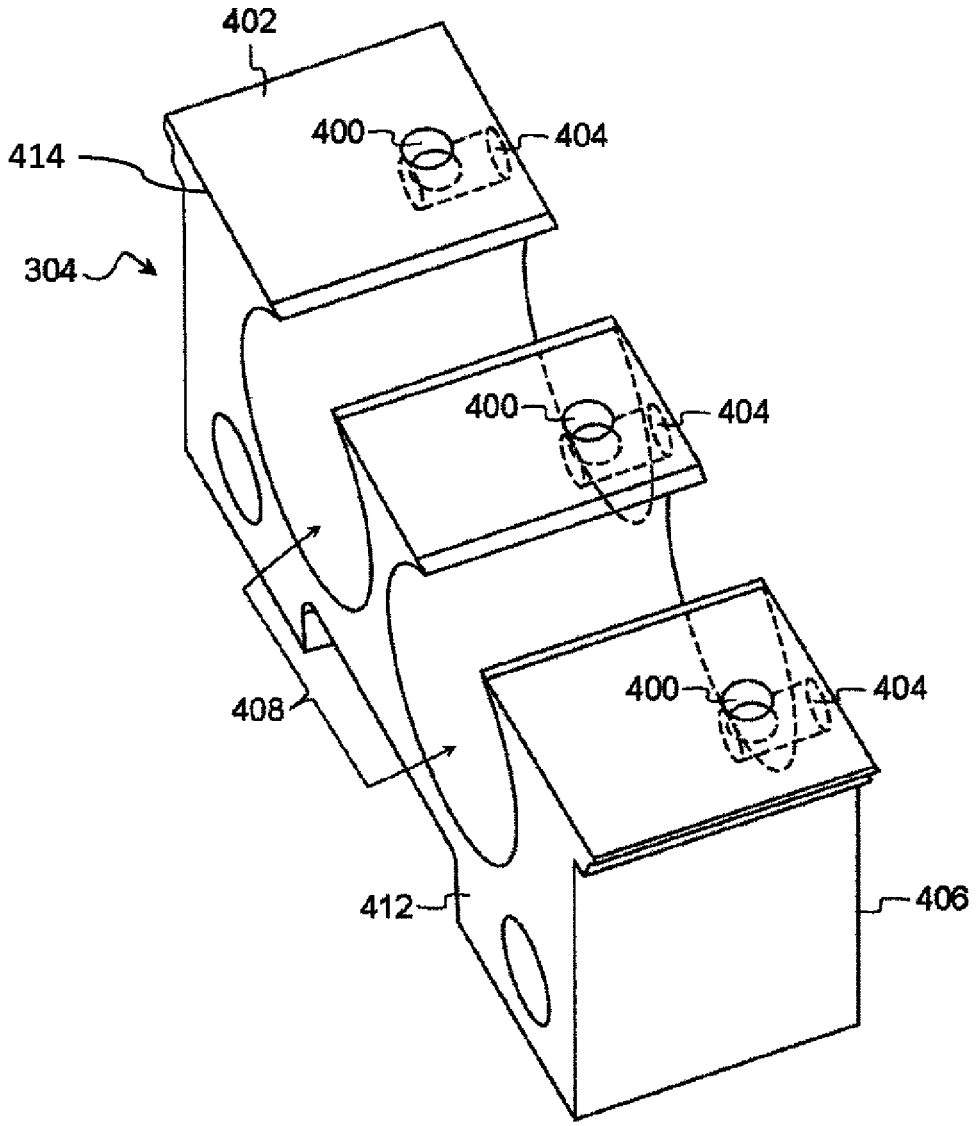
FIG. 5 is a perspective view of an example of an edge seal 304 according to an aspect of the invention.

Edge seals 304 direct a vacuum to the edges of the print media as described in co-pending U.S. application Ser. No. 14/016,486. FIG. 5 is a perspective view of an example of edge seal 304. Edge seals 304 include vacuum openings 400 formed in a print media contact surface 402, and side vacuum openings 404 formed in an inner surface 406. The vacuum opening and a corresponding side vacuum opening form a tunnel or channel through the edge seal 304 that direct a vacuum produced by the vacuum manifold 220 to the print media contact surface 402.

Guide surface cutouts 408 are formed through the edge seal and have a shape that corresponds to the shape of the guide surfaces 302. The guide surface cutouts 408 provide a sufficient clearance gap 410 between the guide surfaces 302 and the guide surface cutouts 408 to allow the guide surfaces to freely rotate as the print media 112 moves over the guide surfaces. While the guide surface cutouts 408 provide clearance around the guide surfaces 302, the length of the clearance gap 410 (see FIG. 4) which corresponds to the distance between the inner surface 406 and the outer surface 412 of the edge seal 304 provides sufficient flow impedance to limit the amount of air that can flow through the clearance gap to enter the vacuum manifold. The guide surfaces 302 and the guide surface cutouts 408 are disposed in the edge seals 304 such that the surface of the guide surfaces 302 that contacts the print media is horizontal or parallel with the plane defined by the contact of the print media with the print media contact surface 402.

The vacuum produced at vacuum openings 400 holds (without sticking) the print media to the print media contact surface 402. The print media contact surface 402 is preferably made of or coated with a slippery material in an aspect according to the invention. This allows the print media to more easily slide over the print media contact surface 402. One example of a slippery material is acetal copolymer 20% PET, distributed by DuPont™ under the trademark Delrin®.

The vacuum provided by the vacuum manifold acts on the print media, the vacuum force pulling the print media 112 towards the vacuum manifold 220 and the edge seals 304 bows the print media downward, away from the linehead 106 between the rollers and increases the wrap angle of the print media around the rollers 212 (see FIG. 4). The bowing of the print media 112 away from the linehead 106 provides additional clearance between the linehead and the print media, which can reduce the risk of flutes in the print media contacting the bottom face of the linehead. Holding the edges of the print media 112 against the print media contact surfaces 402 of the edge seals 304 reduces the amount of air leaking into the vacuum manifold between the edge seals 304 and the print media. By preventing or reducing the air flow between the edge seals and the print media, it reduces or prevents the edges of the print media from vibrating like a reed. As the vibration of the edges of the print media can adversely affect the quality of the images printed on the print media, use of the edge seals can improve print quality. Reducing the air leakage around the edges of the print media in this manner lowers the flow rate requirements of the vacuum source, which can lower the cost of the vacuum source. The reduced air leakage around the edges of the print media also helps to ensure a more uniform vacuum level all the way to the edges of the print media. It therefore helps to ensure a more uniform deflection of the print media toward the vacuum manifold across the width of the vacuum manifold.

Figure 6:
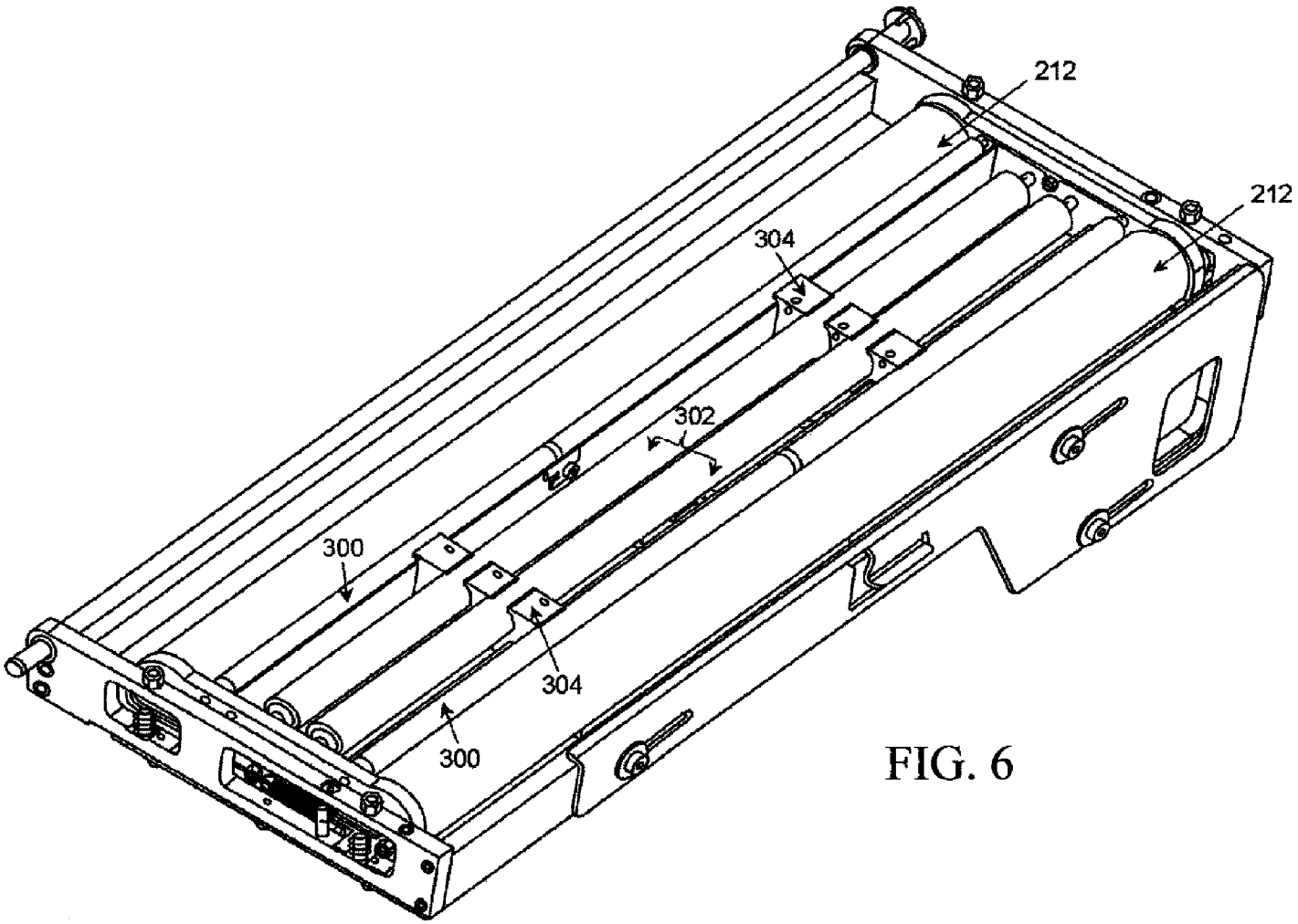
FIG. 6 is a perspective view of a portion of the printing system showing the layout of the edge seals according to an aspect of the invention.

Referring now to FIG. 6, there is shown an example layout of the rollers 212, sealing rollers 300, guide surfaces 302, and edge seals 304 in an aspect according to the invention. The edge seals 304 move or slide along the guide surfaces 302, allowing the locations of the edge seals 304 to be adjustable. This allows the locations of the edge seals 304 to be customized for various widths of print media 112. In one aspect, the outside edges of the edge seals 304 (see 414 in FIG. 5) are positioned to coincide with the edges 330 of the print media 112.

FIG. 7 shows a perspective view of the vacuum manifold 220. The rollers, sealing rollers, and guide surface rollers have been hidden to allow features of the vacuum manifold to be seen. The vacuum manifold 220 is fluidically coupled to the vacuum source 224 (FIG. 3) via a vacuum port 324, which is located in a central portion of the vacuum manifold. The effective width of the vacuum manifold is controlled by the placement of the edge seals 304, which are preferably aligned with the edges 330 of the print media 112. The position of the edge seals can be adjusted by means of actuators 320. The actuators are coupled to the edge seals in this embodiment by means of lead screws 322. The edge seals each include a threaded hole 326 and a clearance hole 328. The clearance hole provides clearance for the lead screw, while the threaded hole 326 engages the threads of the lead screw. As the right edge seal is rotated 180 degrees about a vertical axis relative to the left edge seal, the threaded holes of the two edge seals engage different lead screws. This allows the two edge seals to be independently positioned by the actuators 320. Alternatively other types of actuators, such as belt drives, can used to position the edge seals.

If the edge seals 304 are positioned out beyond the edge of the print media, the edge seals can't provide an air seal to the print media, allowing a large amount of air to flow in around the edges of the paper. The large influx of air into the vacuum manifold results in a reduction in the vacuum level in the vacuum manifold. This reduces the force on the print media to deflect it away from the adjacent linehead, which is undesirable. If the edge seals are positioned in-board of the edge of the print media, the edge seal can provide the desired air seal to the print media. However, those portions of the print media that extend beyond the edge seals don't encounter a vacuum force to deflect those portions of the print media away from the print media.

To determine the proper position of the edge seals 304, a system controller 228 measures a first signal indicative of the blower or other vacuum source activation level or force and a second signal indicative of the vacuum level in the vacuum manifold. Measurements of the first signal indicative of the blower or other vacuum source activation level or force include, but are not limited to, the drive voltage level to the vacuum source, the current flow to the vacuum source, the phase difference between the vacuum source drive voltage and the current, the duty cycle of a pulse width modulated vacuum source, the rotational rate (rpm) of the blower or other vacuum source, or the position of a valve that alters the flow of air from the vacuum manifold to the vacuum source. The second signal indicative of the vacuum level in the vacuum manifold can be provided by a vacuum sensor 226, such as a vacuum gauge, fluidically coupled directly to the vacuum manifold 220 to provide a direct measurement of the vacuum in the vacuum manifold, as shown for the left vacuum assembly in FIG. 3.

Alternatively, the second signal can be a vacuum gauge 226 coupled to some location in the vacuum duct that connects the vacuum manifold 220 to the vacuum source 224. The second signal can alternatively be provided through various direct or indirect measurements of the vacuum level in the vacuum manifold that include but are not limited to, a strain gauge 332 attached to a wall of the vacuum manifold to measure the deformation of the vacuum manifold walls produced by the vacuum as shown in FIG. 7, a force gauge measuring the force applied to one or more guiding surfaces by the print media as it is pulled into contact with the guiding surfaces by the vacuum, a force gauge measuring the force applied by the vacuum to the movable edge seals, or a flow gauge measuring the flow rate of the air through the vacuum duct between the vacuum manifold and the vacuum source.

In an aspect of the invention, the vacuum source 224, such as a blower, a pump, or a venturi-type vacuum source, is energized by a servo-control system 228. The servo-control system controls the vacuum source 224 to maintain a constant vacuum level in the vacuum manifold, as monitored by a vacuum sensor 226 (see FIG. 3). The control of the activation level of the vacuum source can include controlling the power supplied to the vacuum source. The power supplied to the vacuum source can comprise electrical power supplied to blower or pump types of vacuum source, or it can comprise power provided by the motive fluid of a venturi-type of vacuum source. In an alternate aspect of the invention, the control of the vacuum source can include adjusting an activation level by adjusting a control valve to alter the flow impedance of either the vacuum duct between the vacuum manifold and the vacuum source or the exhaust line from the vacuum source. In another alternate aspect of the invention, the control of the activation level of the vacuum source can include adjusting an air bleed control valve that controls the flow of the air through an air bleed port, which is fluidicaily coupled in parallel to the vacuum manifold.

Figure 8:
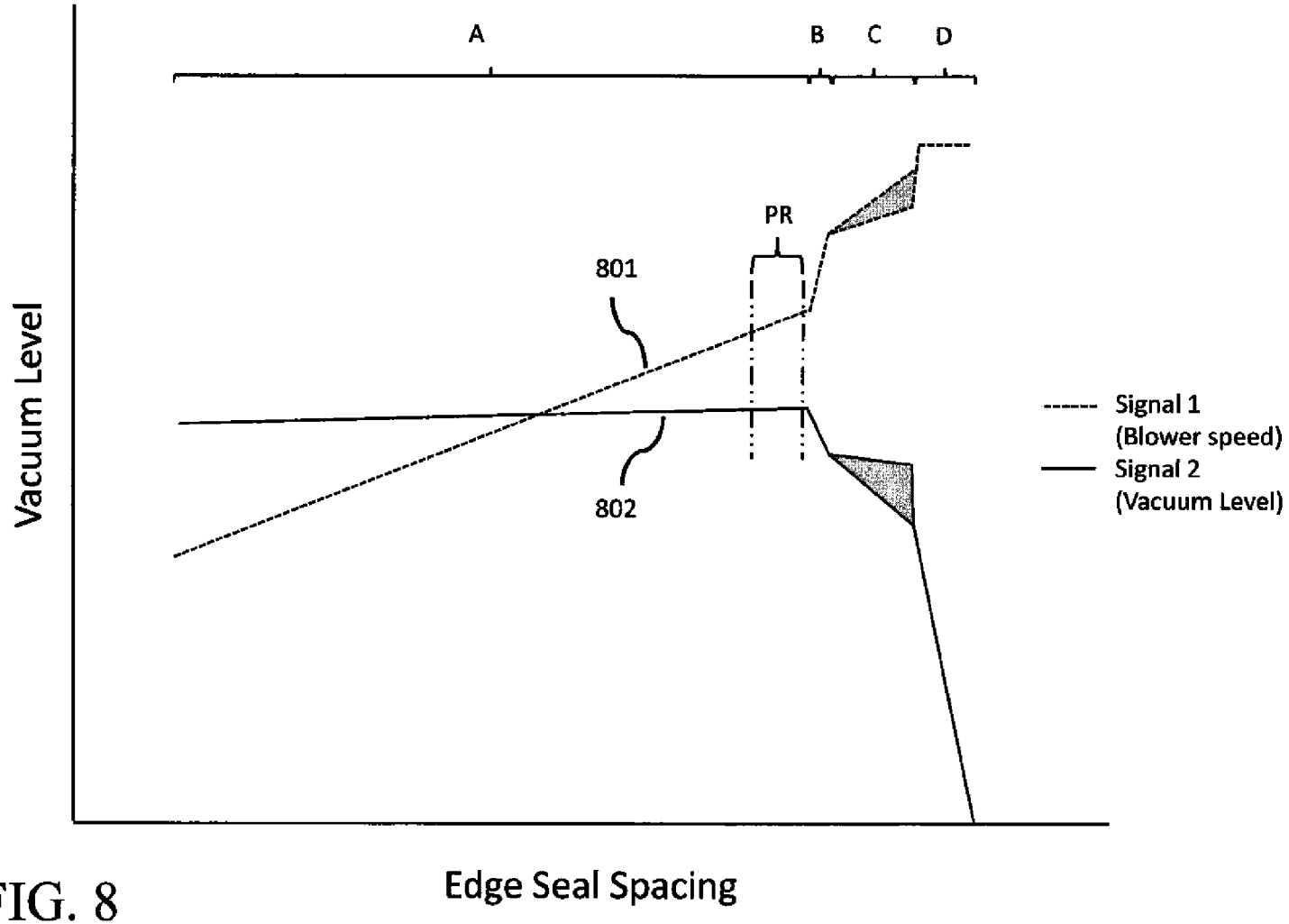
FIG. 8 shows response curves for activation level and vacuum level as a function of the position of the edge seals according to an aspect of the invention.

FIG. 8 shows an example of a first response curve 801 representing the activation level of the vacuum source and a second response curve 802 representing the vacuum level in the vacuum chamber. As shown in FIG. 8, the vacuum level in the vacuum chamber or vacuum manifold varies depending on the position of the edge seals. The servo-control system compensates for these changes in vacuum level by adjusting the power applied to the vacuum source, or its activation level, as discussed above. As a result, each downward shift of the vacuum level is accompanied by a corresponding upward shift in the vacuum source activation level, such as a blower speed, shown in FIG. 8 as the response curve 801. The amount of upward shift of the blower speed for a given downward shift is a function of particular response function of the vacuum source to various servo-control system setup parameters. The response curves are therefore provided to illustrate the concepts and are not to be considered representative of any particular operating unit. The response curves show four distinct operating regions, labeled A-D. In region A, the edge seals 304 are aligned to provide an air seal to the print media. There is a small downward slope to the vacuum level as a function of edge seal position. This is an indication that the amount of air pulled into the vacuum manifold varies linearly with the distance between the edge seals within this region. The linear dependence of the air flow comes in part from the leakage of air into the vacuum manifold through the clearance gap 310 between the sealing rollers 300 and the wall of the vacuum manifold that extends from one edge seal 304 to the other edge seal. Additional air can enter the vacuum manifold by flowing through the portion of the porous print media itself that is between the two edge seals 304. This flow rate of air through the print media depends on the porosity and the thickness of the print media.

As the spacing between the edge seals increases, there is an abrupt drop in vacuum level response curve 802, and an associated abrupt rise in the activation level response curve 801 in region B. This drop in vacuum level comes as the spacing of the edge seals is such that the vacuum holes in the print media contact surface 402 of the edge seals are not completely covered by the print media. Air can then begin to flow into the vacuum manifold via the vacuum openings 400 and the side vacuum openings 404 (see FIG. 5). As increasing amounts of the vacuum openings are no longer covered by the print media, increasing amounts of air can flow into the vacuum manifold, lowering the vacuum levels there, which the vacuum servo compensates for by increasing the power to the blower or other vacuum source.

As region B transitions to region C, the spacing of the edge seals is such that the edges 330 of the print media are located between the vacuum openings and the inner edge of the print media contact surface 402 of edge seals 304. Since further increases in the spacing of the edge seals don't change the amount of air that can flow through the vacuum openings 400 of the edge seals, the slope of the vacuum level vs. spacing can flatten out toward the slope of the curve in region A. However since the print media no longer covers the vacuum openings of the edge seal, the print media is no longer held in good contact with the edge seals. As a result, the edges of the print media can begin to flutter like a reed, sometimes in contact with the edge seal and sometimes moved away from the edge seal. When the print media is moved away from the edge seal, air can be drawn into the vacuum manifold. As a result of the erratic seal between the print media and the edge seal, the air flow into the vacuum manifold and the vacuum level in the vacuum manifold tends be erratic. The erratic nature of the vacuum level is denoted in the figure as the shaded triangular region. In general, more air gets drawn into the vacuum manifold as the edge 330 of the print media lies closer to the inside edge of the print media contact surface.

In region D, the edge seals are positioned outward of the edges of the print media. Air can readily enter the vacuum chamber or manifold around the edges of the print media, producing the steep drop off of vacuum level in regions D. The vacuum servo tries to compensate by increasing the power to the blower, until it hits the maximum power of the blower or vacuum source at which point the blower speed hits its maximum.

The operation of the vacuum manifold is most effective when the edge seals spacing is in operating region A, but close to the onset of region B; the spacing range marked PR. Such a placement ensures that the vacuum manifold pulls the print media down, away from the linehead, all the way out to the edges of the print media. These response curves can be used in conjunction with the known width of the print media to determine whether the edge seals are properly spaced. If the measured first signal or second signal amplitudes are larger or smaller than the signals expected from response curves 801 and 802, it can be determined whether the edge seal spacing should be increased or decreased to produce the desired spacing of the edge seals in the preferred operating region PR. In this way, a comparison of the measured first or second signal to the corresponding response curves for the print medium of the appropriate width produces an error signal indicating when the edge seals do not correspond to the width of the movable print medium.

Figure 9:
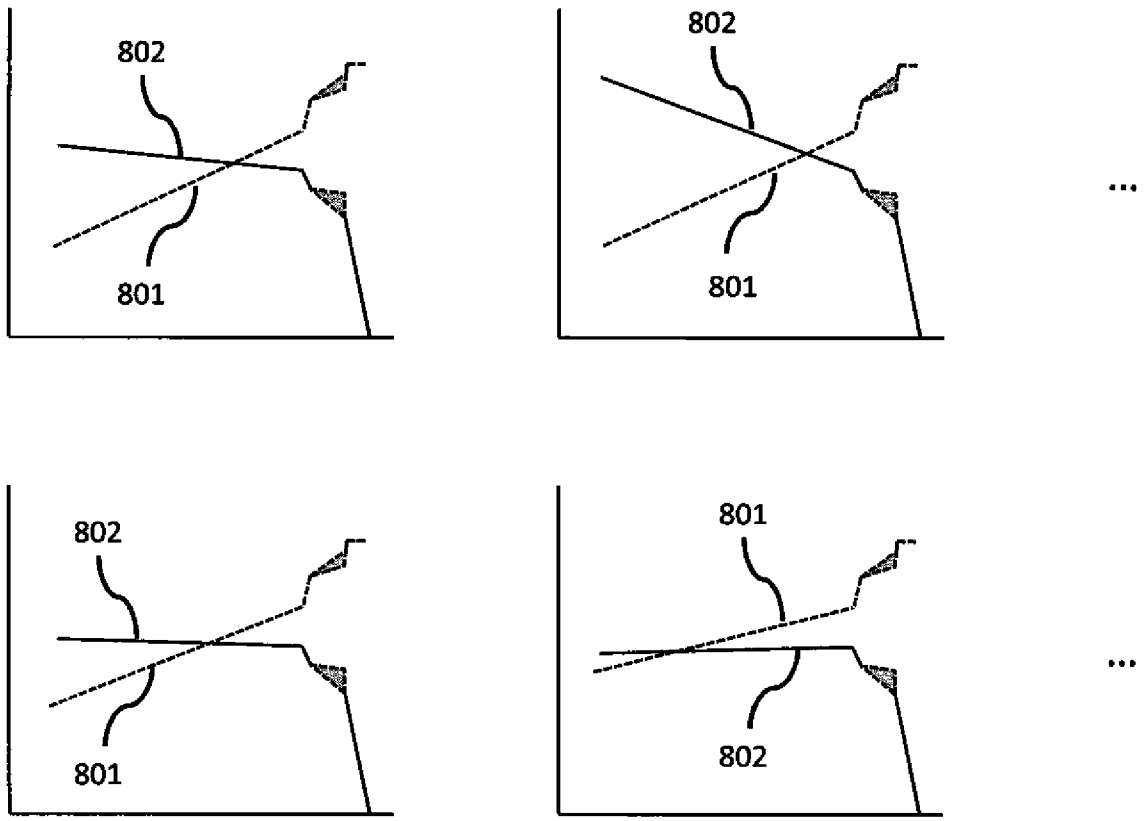
FIG. 9 shows a plurality of response curves for activation level and vacuum level as a function of the position of the edge seals according to other aspect of the invention.
Figure 10:
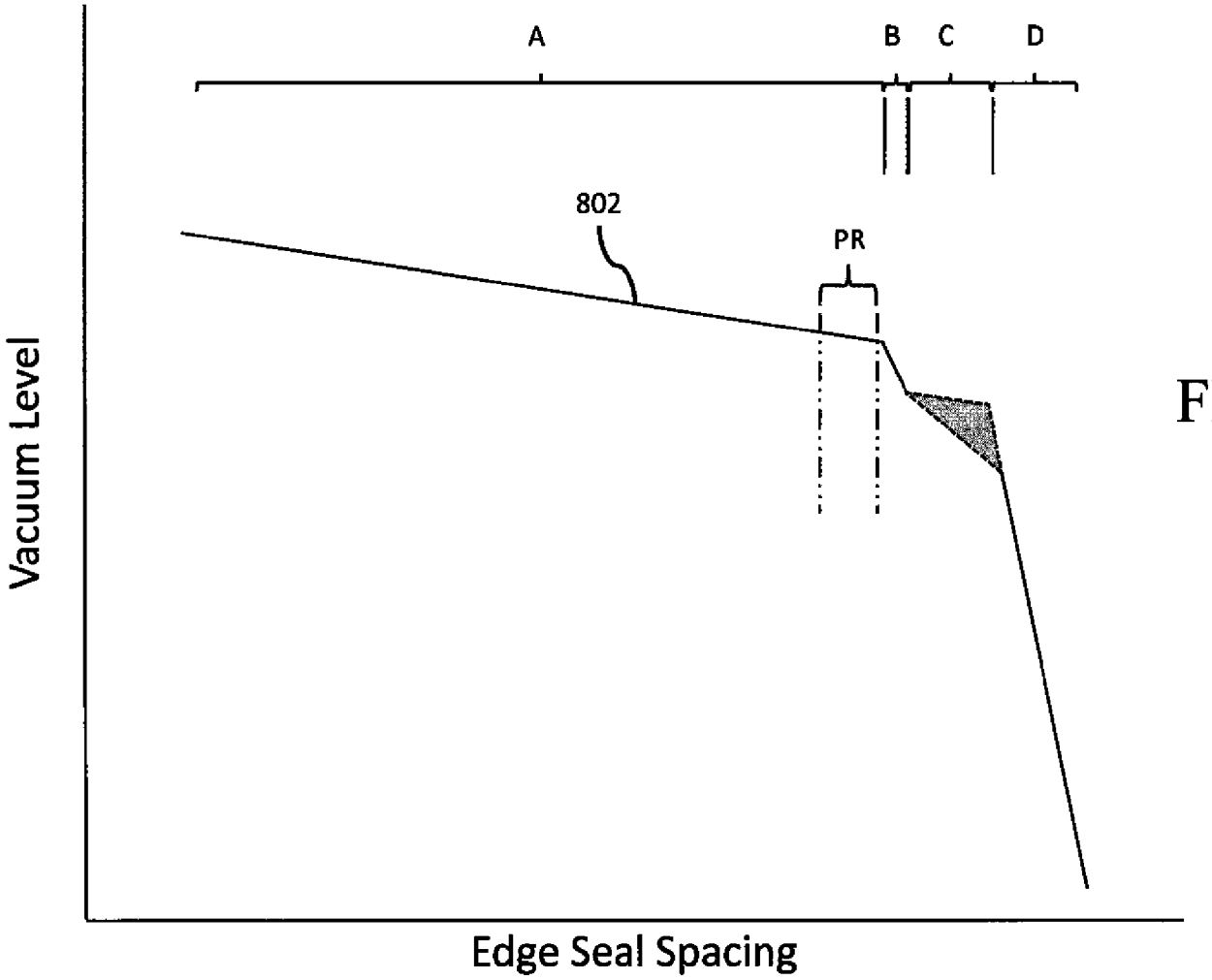
FIG. 10 shows a response curve for vacuum level as a function of the position of the edge seals according to another aspect of the invention.

As response curves can depend on the print media, as a result of differences in the porosity and the thickness of the print media, the printing system can include a library of response curves for storing a plurality of response curves for different known print media having different widths, materials, and thickness. FIG. 9 shows a library of stored response curves. When a print job is printed having a known print media, the proper response curve(s) can be retrieved from the library for comparison with at least one of the measured first signal and second signal. If a print job involves printing with an unknown print media, the controller can generate new response curve(s), which can be stored in the library for future reference. The response curves in the library can in various embodiments be stored as look up tables, or curves, or potentially as equation(s). The response curves stored in the library can each span the entire adjustment range of the edge seals, as is shown in FIGS. 8-10. Alternatively, since the desired placement of the edge seals is near the region A to region B transition, the stored response curves may be limited to a much more narrow adjustment range in the vicinity of the region A to region B transition.

FIG. 10 illustrates a response curve in an alternate aspect of the invention, where the vacuum source 224 is operated at a constant level, instead of being servo-controlled. In such a system, the first signal representing the vacuum source force or drive level is constant. The measured vacuum level in the vacuum manifold corresponds to the second response curve 802. The response curve 802 vs. edge seal spacing shows four distinct operating regions, labeled A-D. These distinct operating regions can be understood as being produced in the same manner as the regions A-D of FIG. 8. The measured second signal can be compared to an appropriate response curve from the library of stored response curves to determine whether the edge seals are properly positioned.

In another aspect of the invention, the edge seals are moved from a first position to a second position and the first and second signals are measured at both positions. The change in signal level can then be compared with the slope of the appropriate response curve to determine whether the edge seal spacing is in region A. In some aspects of the invention, the edge seal can be moved to a third position, a third signal measured at the third position, and the change in signal level between the second and third position compared to the slope of the response curve to determine whether the edge seal spacing is in region B.

A method according to an aspect of the invention includes sliding edge seals to create a sealed vacuum to the print media. The vacuum system can utilize a Proportional/Integral control loop (PI) with a vacuum sensor to ensure that a desired vacuum level is reached and maintained while the printing system is in operation. By way of example only, the printing system can use print media of various widths, preferably from 8 inch wide to 25.5 in wide. The positions of the edge seals can be adjusted to match the media width, for the system to work properly. The control system increases or decreases the power to the blower to achieve the desired vacuum set point at the onset of printing system start. The system can easily detect if the edge seals are out of position, for example wider than the print media. The control loop increases the power to the blower to try to achieve the desired vacuum set point. Once the blower power reaches 100% and the vacuum level still has not been achieved, an error can be declared. Detecting when the edge seals are out for position, for example too narrow for the paper width can be more difficult. It is easily understood that when the edge seals are narrower than the paper, the PI control loop will be able to achieve the vacuum level even though the edge seals are out of position.

The inability to detect the position of the edge seals when they are set too narrow for the paper width can lead to degradation of image quality. A controlled vacuum leak can be added to the system to determine the edge seal position when it is narrower than the width of the print media. Adding an opening in the vacuum box that changes size with the position of the edge seals would result in the power applied to the blower to vary with the position of the edge seals to achieve and maintain the correct vacuum set point. A simple calibration routine would be required to "map" the edge seal position vs. blower power, for any given print media. Since the controller knows the width and type of the print media being run, the expected blower power can be identified. On start up of the printing system, the power applied to the blower can be detected and an error condition can be declared if the blower power applied falls outside of the expected range.

Figure 11:
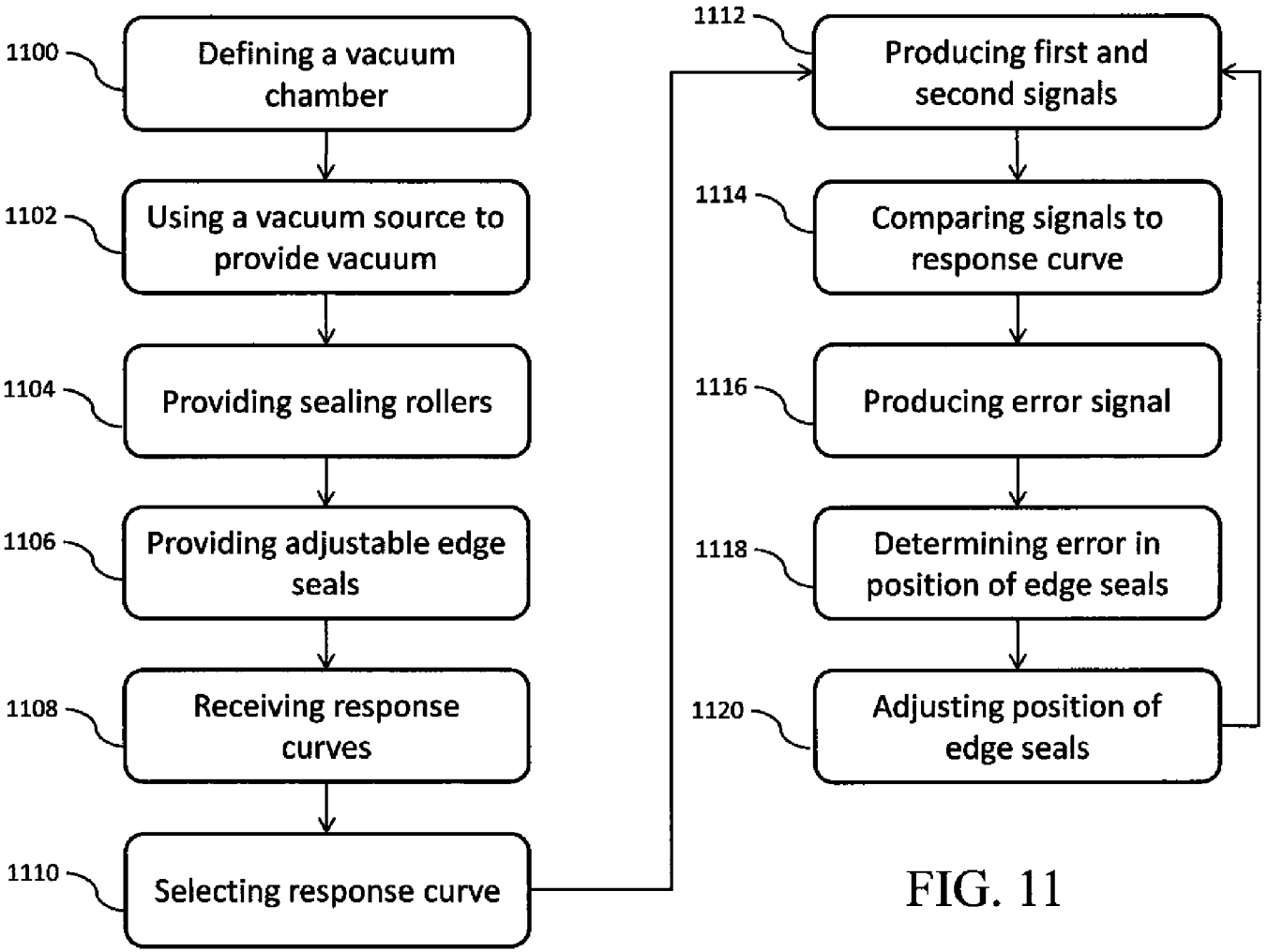
FIG. 11 shows a flowchart for a method for determining whether the edge seals are positioned correctly according to an aspect of the invention.

FIG. 11 shows a flowchart for a method for applying vacuum force across a width of a web of movable print medium as it moves through a printing system and determining if positions of a pair of adjustable edge seals do not correspond to the width of the movable print medium. The method comprises defining a vacuum chamber (step 1100), using a vacuum source to provide vacuum in the vacuum chamber (step 1102), and providing spaced sealing rollers (step 1104) in relation to the vacuum chamber to define an opening in the vacuum chamber. The movable print medium passes over the opening and is guided by the sealing rollers. The method further includes providing the pair of adjustable edge seals (step 1106) between the spaced sealing rollers at a first position, receiving a plurality of response curves (step 1108) for different known print media having different widths, materials, or thickness, and selecting appropriate response curves (step 1110) from the plurality of response curves. Steps 1112-1120 can be performed once or, optionally, repeated until some condition is satisfied. The condition can be the error signal falling below a threshold level indicating that the edge seals are correctly positioned and aligned with the edges of the print media in a widthwise fashion.

The repeatable steps of the method shown in FIG. 11 include producing a first signal indicative of the activation level of the vacuum source and a second signal indicative of the vacuum level in the vacuum chamber (step 1112) and using a controller to compare the first and second signals (step 1114) to the selected response curves to produce an error signal (step 1116) indicating whether the first position of the pair of edge seals does not correspond to the width of the movable print medium. Optionally, the method can also include adjusting the position of the edge seals based on the error signal by using the error signal to determine an error in the position of the edge seals (step 1118) and adjusting the position of at least one of the pair of edge seals in response to the error signal (step 1120).

In an aspect of the invention, the method can further include moving at least one of the edge seals to a second position and measuring the change in the vacuum level between the first position and the second position to determine a change in an operating region of the response curves. The edge seals can be moved to a plurality of positions to measure the change in the vacuum level between the previous position and the current position to determine a change in the operating region of the response curves. This permits the positioning of the edge in the tail-end of operating region A of the response curve, just before operating region B. Iteratively moving the edge seals and producing error signals permits the positioning of the edge seals such that the adjusted position of the edge seals corresponds to edges of the movable print medium, thereby varying the size of the opening in the vacuum chamber so that an appropriate vacuum force is applied across the width of the movable print medium.

In some aspects of the invention, the sealing rollers are disposed at two positions in an intrack direction and extending parallel to a crosstrack direction relative to the movement of the movable print medium. The edge seals are disposed at two positions in a crosstrack direction and extending parallel to an intrack direction relative to the movement of the movable print medium.

In some aspects of the invention, producing the first and second signals includes adjusting the activation level of the vacuum source to adjust the vacuum level in the vacuum chamber until the pressure sensor indicates that the vacuum level in the vacuum chamber corresponds to a target vacuum level for the movable print medium while monitoring the first signal. In other aspects of the invention, producing the first and second signals includes adjusting the activation level of the vacuum source until the first signal corresponds to a target activation level of the vacuum source for the movable print medium while monitoring the second signal.

In various aspects of the invention, the vacuum source can be a blower and the speed of the blower can be measured to produce the first signal. The activation level of the vacuum source can be measured using the drive voltage level to the vacuum source, the current flow to the vacuum source, the phase difference between the vacuum source drive voltage and the current, the duty cycle of a pulse width modulated vacuum source, the rotational rate of the vacuum source, or the position of a valve that alters the flow of air from the vacuum chamber to the vacuum source.

In various aspects of the invention, the vacuum level in the chamber is measured using a vacuum sensor such as a vacuum gauge fluidically coupled to the vacuum chamber or to a vacuum duct that connects the vacuum chamber to the vacuum source. The vacuum level in the chamber can also be measured using a strain gauge attached to a wall of the vacuum chamber to measure the deformation of the vacuum chamber wall produced by the vacuum, a force gauge measuring the force applied to one or more guiding surfaces by the movable print medium as it is pulled into contact with the guiding surfaces by the vacuum, a force gauge measuring the force applied by the vacuum to the edge seals, or a flow gauge measuring the flow rate of the air through a vacuum duct between the vacuum chamber and the vacuum source.

In various aspects of the invention, the vacuum source can be a blower, a pump, or a venturi-type vacuum source.

In an aspect of the invention, an apparatus for causing a vacuum force to be applied at a target vacuum level across a width of a web of movable print medium as it moves through a printing system and for determining whether positions of adjustable edge seals of the apparatus do not correspond to edge positions of the movable print medium comprises a vacuum chamber connected to a vacuum source, wherein the vacuum source provides vacuum to the vacuum chamber; spaced sealing rollers, disposed in relation to the vacuum chamber, wherein the spaced sealing rollers define an opening in the vacuum chamber, and wherein the movable print medium passes over the opening and is guided by the sealing rollers; the adjustable edge seals disposed between the spaced sealing rollers at a first position; a sensor for measuring a vacuum level in the vacuum chamber; and a controller having controller accessible memory for storing a plurality of response curves for different known print media having different widths, materials, or thickness, responsive to the vacuum source and the sensor, for producing a first signal indicative of an activation level of the vacuum source and a second signal indicative of the vacuum level in the vacuum chamber, and for comparing the first and second signal to appropriate response curves corresponding to the movable print medium to produce an error signal indicating whether the first position of the pair of edge seals does not correspond to the width of the movable print medium.

The apparatus can further include means for adjusting the position of at least one of the edge seals to at least one new position in response to the error signal. The new position of the edge seals can correspond to a change in an operating region of the response curves. In another aspect of the invention, the new position of the edge seals corresponds to edges of the movable print medium so that an appropriate vacuum force is applied across the width of the movable print medium. The means for adjusting the positions of the edge seals can include separate means for adjusting the position of each of the edge seals independently of the position of the other edge seal. Alternately, the means for adjusting the positions of the edge seals can comprise means to adjust the position of a first edge seal and a second edge seal concurrently such that a midpoint between the first edge seal and the second edge seal is substantially fixed independent of a spacing between the first edge seal and the second edge seal and corresponds to a midpoint of the width of the movable print medium.

In an aspect of the invention, the apparatus can include means responsive to the controller for adjusting the activation level of the vacuum source to adjust the vacuum level in the vacuum chamber until the pressure sensor indicates that the vacuum level in the vacuum chamber corresponds to a target vacuum level for the movable print medium while monitoring the first signal. In another aspect of the invention, the apparatus can include means responsive to the controller for adjusting the activation level of the vacuum source until the first signal corresponds to a target activation level of the vacuum source for the movable print medium while monitoring the second signal. In some aspects of the invention, the apparatus can include a clearance gap between the sealing rollers and a wall of the vacuum chamber, the clearance gap extending around a portion of the sealing rollers. Preferably, the clearance gap extends around at least an eighth of the circumference of the sealing roller.

Figure 12:
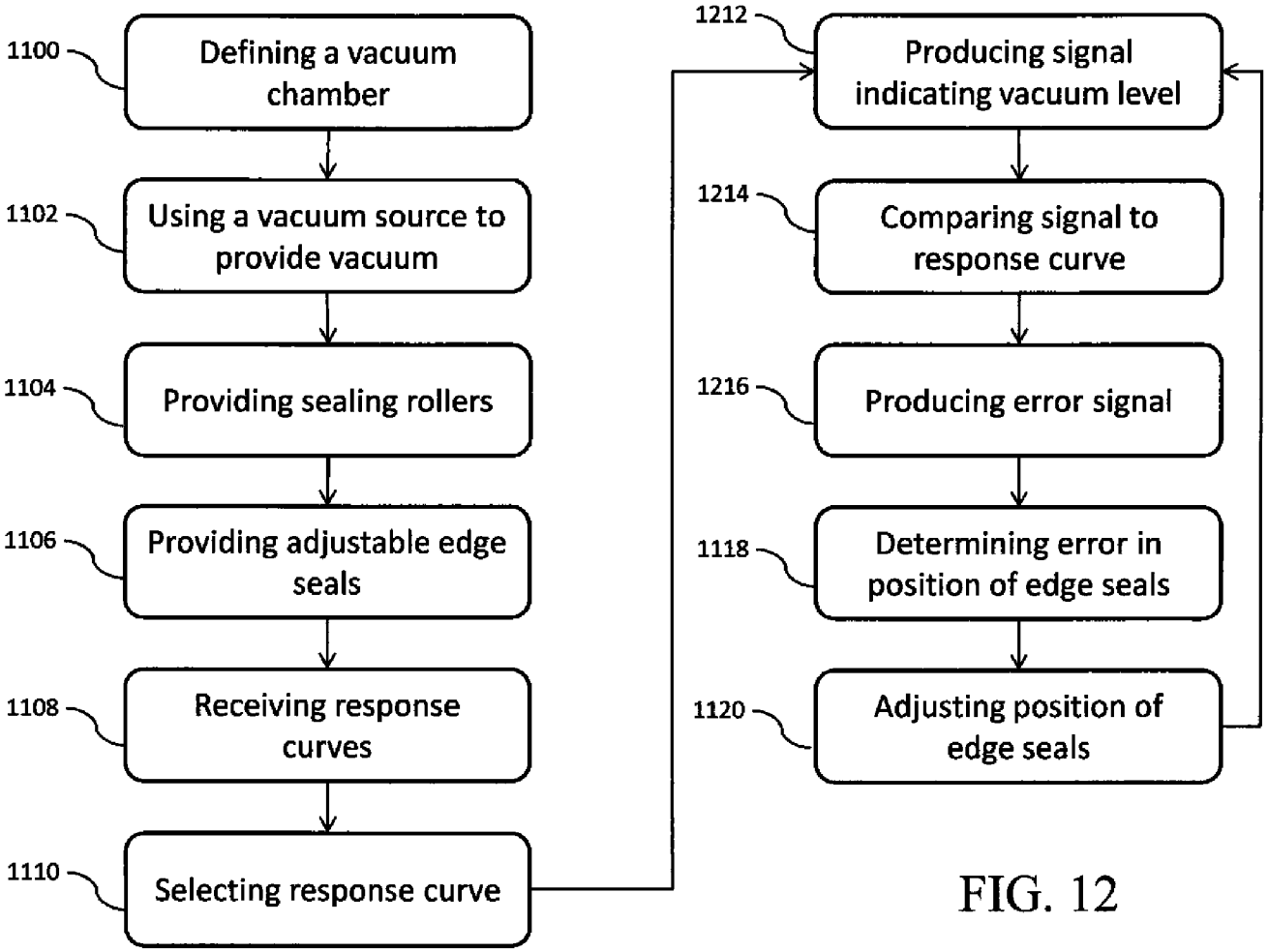
FIG. 12 shows a flowchart for a method for determining whether the edge seals are positioned correctly according to another aspect of the invention.

FIG. 12 shows a flowchart for a method for applying vacuum force across a width of a web of movable print medium as it moves through a printing system and determining if positions of a pair of adjustable edge seals do not correspond to the width of the movable print medium. The method comprises defining a vacuum chamber (step 1100), using a vacuum source to provide vacuum in the vacuum chamber (step 1102), and providing spaced sealing rollers (step 1104) in relation to the vacuum chamber to define an opening in the vacuum chamber. The movable print medium passes over the opening and is guided by the sealing rollers. The method further includes providing the pair of adjustable edge seals (step 1106) between the spaced sealing rollers at a first position, receiving a plurality of response curves (step 1108) for different known print media having different widths, materials, or thickness, and selecting an appropriate response curve (step 1110) from the plurality of response curves. The method includes additional steps (1212, 1214, 1216, 1118, and 1120) that can be performed once or, optionally, repeated until some condition is satisfied. The condition can be the error signal falling below a threshold level indicating that the edge seals are correctly positioned and aligned with the edges of the print media in a widthwise fashion.

The repeatable steps of the method shown in FIG. 12 include producing a signal indicative of the vacuum level in the vacuum chamber (step 1212) and using a controller to compare the signal (step 1214) to the selected response curve to produce an error signal (step 1216) indicating whether the first position of the pair of edge seals does not correspond to the width of the movable print medium. Optionally, the method can also include adjusting the position of the edge seals based on the error signal by using the error signal to determine an error in the position of the edge seals (step 1118) and adjusting the position of at least one of the pair of edge seals in response to the error signal (step 1120).

Figure 13:
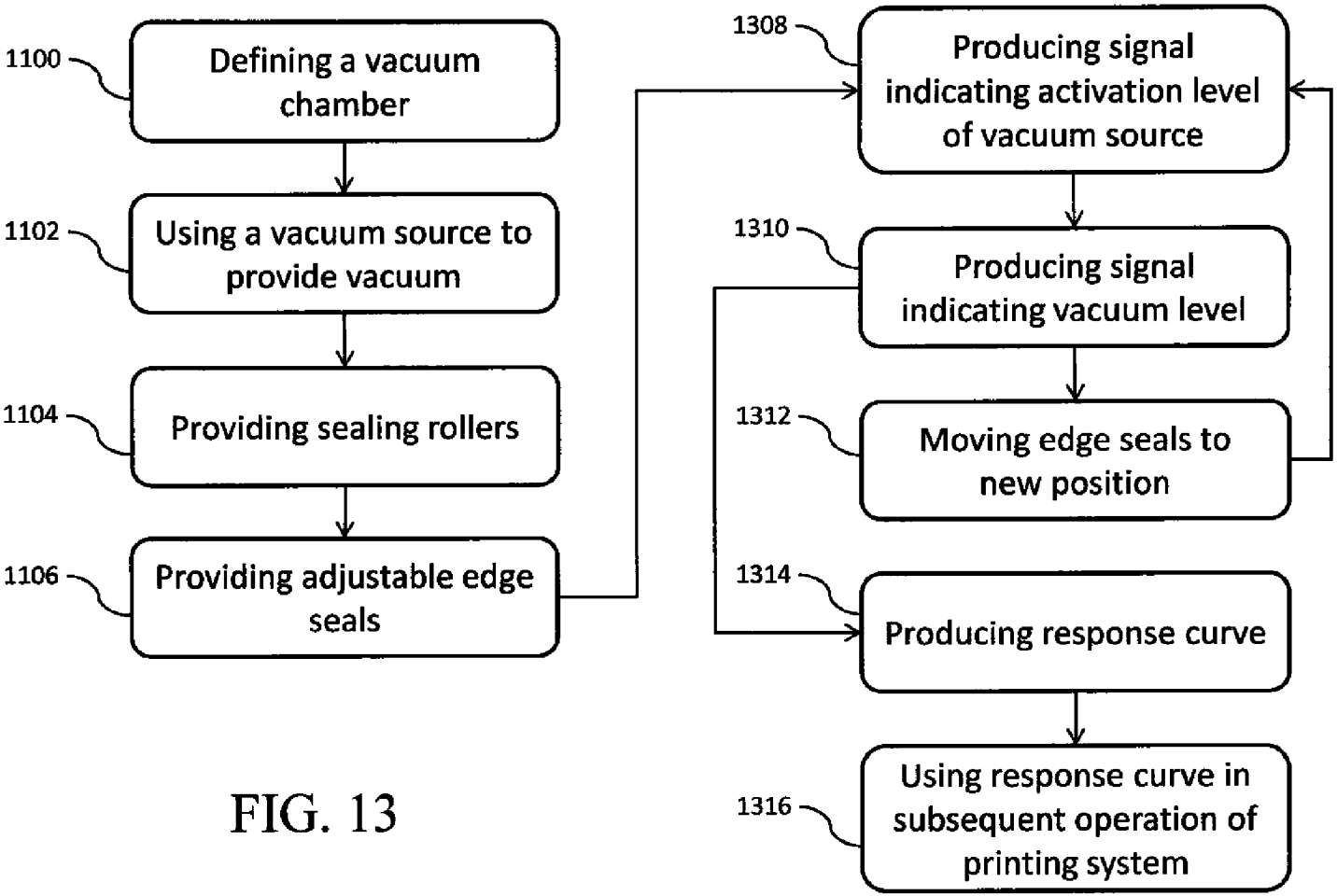
FIG. 13 shows a flowchart for a method for generating response curves according to an aspect of the invention.

FIG. 13 shows a flowchart for a method for generating a response curve for adjusting the positions of a pair of adjustable edge seals to the width of a movable print medium in a printing system. The method comprises defining a vacuum chamber (step 1100), using a vacuum source to provide vacuum in the vacuum chamber (step 1102), and providing spaced sealing rollers (step 1104) in relation to the vacuum chamber to define an opening in the vacuum chamber. The movable print medium passes over the opening and is guided by the sealing rollers. The method further includes providing the pair of adjustable edge seals (step 1106) between the spaced sealing rollers at a first position. In step 1308, a first signal indicative of the activation level of the vacuum source at the first position of the edge seals is produced. In step 1310, a second signal indicative of the vacuum level in the vacuum chamber for the first position of the edge seals is produced. In step 1312, the pair of adjustable edge seals is moved to a new position. Steps 1308 and 1310 are repeated to produce a new first signal indicative of the activation level of the vacuum source and a second signal indicative of the vacuum level in the vacuum chamber for the at least one new position. Steps 1312, 1308, and 1310 can be repeated for a plurality of positions to acquire a plurality of signals at different spacings between the edge seals for the particular print medium. In step 1314, a controller is used to produce a response curve using the first or second signals produced at the first and at least one new positions. The method can also include, optionally, storing the response curve in processor accessible memory. In step 1316, the response curve can be used to determine an error in the position of the pair of edge seals in subsequent operation of the printing system.

In another aspects of the invention, a system for generating a response curve for adjusting the positions of a pair of adjustable edge seals to the width of a web of movable print medium in a printing system comprises a vacuum chamber connected to a vacuum source, wherein the vacuum source provides vacuum to the vacuum chamber; spaced sealing rollers, disposed in relation to the vacuum chamber, wherein the spaced sealing rollers define an opening in the vacuum chamber, and wherein the movable print medium passes over the opening and is guided by the sealing rollers; the adjustable edge seals disposed between the spaced sealing rollers at a first position; a sensor for measuring a vacuum level in the vacuum chamber; means for adjusting the position of at least one of the adjustable edge seals to at least one new position; and a controller for producing at least one of a first signal indicative of an activation level of the vacuum source and a second signal indicative of the vacuum level in the vacuum chamber for the first position, for producing at least one of a first signal indicative of the activation level of the vacuum source and a second signal indicative of the vacuum level in the vacuum chamber for the at least one new position, and for producing a response curve using the first or second signals produced at the first and at least one new positions. The system can also include controller accessible memory for storing the response curve.

Although the invention has been described with reference to a vacuum assembly positioned opposite a linehead, aspects according to the invention are not limited to this construction. A vacuum assembly can be positioned at other locations in a printing system, and the sealing rollers, guide surfaces, and edge seals can be used to guide the print media as the print media passes over the vacuum assembly. In another aspect of the present invention, the vacuum manifold is positioned between components in the printing system. By way of example only, the components can be a linehead and a dryer. The description above assumes that the edge seals are moved concurrently; however the invention is not limited to such embodiments. The invention can also be practiced in which adjustments are made to the position of a single seal at a time.

The invention has been described in detail with particular reference to certain preferred aspects thereof, but it will be understood that variations and modifications can be effected within the spirit and scope of the invention. And even though specific aspects of the invention have been described herein, it should be noted that the application is not limited to these aspects. In particular, any features described with respect to one aspect can also be used in other aspects, where compatible. And the features of the different aspects can be exchanged, where compatible.

PARTS LIST

60 direction of travel
62 crosstrack direction

64 flute
66 flute
68 roller
70 roller
100 printing system
102 first printing module
104 second printing module
106 lineheads
108 dryers
110 quality control sensor
112 print media
114 transport direction arrow
116 turnover module
200 printing system
202 printheads
204 nozzle arrays
206 support structure
208 heat
212 rollers
214 rollers
216 print zone
218 vacuum assembly
220 vacuum manifold
222 non-print zone
224 vacuum source
226 vacuum sensor
228 controller
300 sealing rollers
302 guide surfaces
304 edge seal
310 clearance gap
320 actuator
322 lead screw
324 vacuum port
326 threaded hole
328 clearance hole
330 media edge
332 strain gauge
400 vacuum openings
402 print media contact surface
404 side vacuum openings
406 inner surface
408 guide surface cutouts
410 clearance gap
412 outer surface
414 edge
801 response curve for activation level
802 response curve for vacuum level
A-D operating regions
PR preferred operating region
1100 step of defining a vacuum chamber
1102 step of using a vacuum source to provide vacuum
1104 step of providing sealing rollers
1106 step of providing adjustable edge seals
1108 step of receiving response curves
1110 step of selecting response curve
1112 step of producing first and second signals
1114 step of comparing signals to response curve
1116 step of producing error signal
1118 step of determining error in position of edge seals
1120 step of adjusting position of edge seals
1212 step of producing signal indicating vacuum level
1214 step of comparing signal to response curve
1216 step of producing error signal
1308 step of producing signal indicating activation level of vacuum source
1310 step of producing signal indicating vacuum level
1312 step of moving edge seals to new position
1314 step of producing response curve
1316 step of using response curve in subsequent operation of printing system

The invention claimed is:

1. Apparatus for causing a vacuum force to be applied at a target vacuum level across a width of a web of movable print medium as it moves through a printing system and for determining whether positions of adjustable edge seals of the apparatus do not correspond to edge positions of the movable print medium, comprising:

a vacuum chamber connected to a vacuum source, wherein the vacuum source provides vacuum to the vacuum chamber;

spaced sealing rollers, disposed in relation to the vacuum chamber, that rotate as the print medium moves over each sealing roller, wherein the spaced sealing rollers define an opening in the vacuum chamber, and wherein the movable print medium passes over the opening and is guided by the sealing rollers;

the adjustable edge seals disposed between the spaced sealing rollers at a first position;

a sensor for measuring a vacuum level in the vacuum chamber; and a controller having controller accessible memory for storing a plurality of response curves for different known print media having different widths, materials, or thickness, responsive to the vacuum source and the sensor, for producing a first signal indicative of an activation level of the vacuum source and a second signal indicative of the vacuum level in the vacuum chamber, and for comparing the first and second signal to appropriate response curves corresponding to the movable print medium to produce an error signal indicating whether the first position of the pair of edge seals does not correspond to the width of the movable print medium.

2. The apparatus according to claim 1, further including means for adjusting the position of at least one of the edge seals to at least one new position in response to the error signal.

3. The apparatus according to claim 2, wherein the new position of the edge seals corresponds to a change in an operating region of the response curves.

4. The apparatus according to claim 2, wherein the new position of the edge seals corresponds to edges of the movable print medium so that an appropriate vacuum force is applied across the width of the movable print medium.

5. The apparatus according to claim 2, wherein the means for adjusting the positions of the edge seals includes separate means for adjusting the position of each of the edge seals independently of the position of the other edge seal.

6. The apparatus according to claim 2, wherein the means for adjusting the positions of the edge seals comprises means to adjust the position of a first edge seal and a second edge seal concurrently such that a midpoint between the first edge seal and the second edge seal is substantially fixed independent of a spacing between the first edge seal and the second edge seal and corresponds to a midpoint of the width of the movable print medium.

7. The apparatus according to claim 1, wherein the sealing rollers are disposed at two positions in an intrack direction and extending parallel to a crosstrack direction relative to the movement of the movable print medium.

8. The apparatus according to claim 1, wherein the edge seals are disposed at two positions in a crosstrack direction and extending parallel to an intrack direction relative to the movement of the movable print medium.

9. The apparatus according to claim 1, wherein the sensor is a pressure sensor used to measure the vacuum level in the vacuum chamber.

10. The apparatus according to claim 9, further including means responsive to the controller for adjusting the activation level of the vacuum source to adjust the vacuum level in the vacuum chamber until the pressure sensor indicates that the vacuum level in the vacuum chamber corresponds to a target vacuum level for the movable print medium while monitoring the first signal.

11. The apparatus according to claim 1, further including means responsive to the controller for adjusting the activation level of the vacuum source until the first signal corresponds to a target activation level of the vacuum source for the movable print medium while monitoring the second signal.

12. The apparatus according to claim 1, wherein the vacuum source is a blower and the first signal is indicative of the speed of the blower.

13. The apparatus according to claim 1, wherein the activation level of the vacuum source is measured using the drive voltage level to the vacuum source, the current flow to the vacuum source, the phase difference between the vacuum source drive voltage and the current, the duty cycle of a pulse width modulated vacuum source, the rotational rate of the vacuum source, or the position of a valve that alters the flow of air from the vacuum chamber to the vacuum source.

14. The apparatus according to claim 1, wherein the sensor is a vacuum gauge fluidically coupled to the vacuum chamber or to a vacuum duct that connects the vacuum chamber to the vacuum source.

15. The apparatus according to claim 1, wherein the sensor is a strain gauge attached to a wall of the vacuum chamber to measure the deformation of the vacuum chamber wall produced by the vacuum, a force gauge measuring the force applied to one or more guiding surfaces by the movable print medium as it is pulled into contact with the guiding surfaces by the vacuum, a force gauge measuring the force applied by the vacuum to the edge seals, or a flow gauge measuring the flow rate of the air through a vacuum duct between the vacuum chamber and the vacuum source.

16. The apparatus according to claim 1, wherein the vacuum source is a blower, a pump, or a venturi-type vacuum source.

17. The apparatus according to claim 1, further including a clearance gap between the sealing rollers and a wall of the vacuum chamber, the clearance gap extending around a portion of the sealing rollers.

18. The apparatus according to claim 17, wherein the clearance gap extends around at least an eighth of the circumference of the sealing roller.

19. The apparatus according to claim 1, wherein each of the adjustable edge seals includes a vacuum opening.

20. The apparatus according to claim 19, wherein the plurality of response curves permit detection of partially uncovered vacuum openings.

* * * * *